US008418815B2

(12) United States Patent
Encinas Carreno et al.

(10) Patent No.: US 8,418,815 B2
(45) Date of Patent: Apr. 16, 2013

(54) REMOTELY OBSERVABLE ANALYSIS FOR AN ELEVATOR SYSTEM

(75) Inventors: Luis C. Encinas Carreno, Farmington, CT (US); George S. Copeland, Wethersfield, CT (US); Juan A. Lence, Madrid (ES)

(73) Assignee: Otis Elevator Company, Farmington, CT (US)

( * ) Notice: Subject to any disclaimer, the term of this patent is extended or adjusted under 35 U.S.C. 154(b) by 320 days.

(21) Appl. No.: 12/921,790

(22) PCT Filed: Apr. 8, 2008

(86) PCT No.: PCT/US2008/059605

§ 371 (c)(1),
(2), (4) Date: Sep. 10, 2010

(87) PCT Pub. No.: WO2009/126140

PCT Pub. Date: Oct. 15, 2009

(65) Prior Publication Data

US 2011/0240414 A1 Oct. 6, 2011

(51) Int. Cl.
*G08B 21/00* (2006.01)

(52) U.S. Cl.
USPC ..... 187/390; 187/247; 187/292; 187/393

(58) Field of Classification Search ..... 187/247, 187/292, 391–393, 396; 340/539.11, 539.22; 706/59
See application file for complete search history.

(56) References Cited

U.S. PATENT DOCUMENTS

| | | | | | |
|---|---|---|---|---|---|
| 4,350,225 | A | | 9/1982 | Sakata et al. | |
| 4,512,442 | A | * | 4/1985 | Moore et al. | 187/393 |
| 4,697,243 | A | * | 9/1987 | Moore et al. | 706/59 |
| 4,698,780 | A | * | 10/1987 | Mandel et al. | 187/393 |
| 4,750,591 | A | * | 6/1988 | Coste et al. | 187/391 |
| 4,930,604 | A | * | 6/1990 | Schienda et al. | 187/393 |
| 4,936,419 | A | * | 6/1990 | Stadler et al. | 187/393 |
| 4,989,695 | A | * | 2/1991 | Kubo | 187/247 |

(Continued)

FOREIGN PATENT DOCUMENTS

| | | |
|---|---|---|
| JP | 10203745 | 8/1998 |
| JP | 2003192248 | 7/2003 |
| JP | 2008024420 | 2/2008 |
| WO | 2006019167 A1 | 2/2006 |

OTHER PUBLICATIONS

International Preliminary Report on Patentability for International application No. PCT/US2008/059605 mailed Oct. 21, 2010.

(Continued)

*Primary Examiner* — Paul Ip
(74) *Attorney, Agent, or Firm* — Carlson, Gaskey & Olds PC

(57) ABSTRACT

An exemplary system for monitoring an elevator arrangement includes a detector arranged to detect conditions or events in, on or near an associated elevator car. A monitoring device monitors a status of the associated elevator car. The monitoring device communicates with the detector for receiving data indicative of any event or condition detected by the detector. The monitoring device provides an output that associates the status of the elevator car at a time of any detected event or condition with an indication of the detected event or condition including a reproduction of the detected event or condition.

23 Claims, 3 Drawing Sheets

U.S. PATENT DOCUMENTS

| | | | | |
|---|---|---|---|---|
| 5,042,621 | A | 8/1991 | Ovaska et al. | |
| 5,135,079 | A * | 8/1992 | Shimazaki | 187/264 |
| 5,787,020 | A * | 7/1998 | Molliere et al. | 702/183 |
| 5,889,239 | A * | 3/1999 | Blackaby et al. | 187/391 |
| 6,763,917 | B2 * | 7/2004 | Utsunomiya et al. | 187/292 |
| 7,004,289 | B2 | 2/2006 | Shrum, III et al. | |
| 7,040,458 | B2 * | 5/2006 | Forsythe et al. | 187/396 |
| 7,298,256 | B2 * | 11/2007 | Sato et al. | 340/539.11 |
| 7,535,355 | B2 * | 5/2009 | Barone | 340/566 |
| 7,823,706 | B2 * | 11/2010 | Tyni et al. | 187/393 |
| 2003/0192745 | A1 * | 10/2003 | Utsunomiya et al. | 187/292 |
| 2004/0262093 | A1 * | 12/2004 | Forsythe et al. | 187/391 |
| 2005/0077117 | A1 | 4/2005 | Shrum, III et al. | |
| 2007/0290842 | A1 * | 12/2007 | Barone | 340/539.22 |
| 2008/0230326 | A1 * | 9/2008 | Tyni et al. | 187/393 |

OTHER PUBLICATIONS

International Search Report and Written Opinion of the International Searching Authority for International application No. PCT/US2008/059605 mailed Dec. 16, 2008.

* cited by examiner

REMOTELY OBSERVABLE ANALYSIS FOR AN ELEVATOR SYSTEM

BACKGROUND

Elevator systems are well known and in widespread use. There are various issues and challenges presented associated with installing elevator system components and maintaining proper operation of an elevator system. If one or more of the elevator system components is not installed properly or stops operating properly, various issues may arise. For example, a component that is not operating properly may cause noise that is disturbing to elevator passengers because they are uncertain of the source of the noise or if it has any impact on their ability to rely upon the elevator. There are a variety of potential sources of noise in an elevator system such as noises associated with brake operation, noises associated with machine (e.g., motor and traction sheave) operation, noises associated with guides that follow along guide rails during elevator car movement and noises associated with car door operation.

The common approach to addressing a noisy elevator component typically involves responding to a customer request for service based upon one or more individuals reporting having heard a noise that they consider unusual in or around the elevator car. Then the elevator servicing company is typically contacted. A technician later arrives, troubleshoots the elevator system to diagnose the situation and make any repair or adjustments as needed.

One drawback associated with the common approach is that it takes a considerable amount of time and effort for many technicians to accurately diagnose a situation and then to take corrective action. Another significant drawback is that the entire process of troubleshooting typically involves removing the elevator from normal service and operating it in an inspection mode. During such times, passengers cannot be serviced by the elevator car, which can be inconvenient at a minimum.

There are known devices that allow technicians to diagnose situations in an elevator system that produce noises. Known devices are portable and carried to the job site by the technician. Such devices are capable of recording sounds and providing some form of visible indication to the technician regarding the recorded sounds. For example, some known devices provide a graphical output indicating sound pressure levels detected by the device.

Those skilled in the art are always striving to make improvements. It would be useful to provide enhanced capabilities for monitoring noises in elevator systems and to improve efficiencies associated with diagnosing and correcting or servicing elevator system components to provide reliable and quiet system operation.

SUMMARY

An exemplary system for monitoring an elevator arrangement includes a detector arranged to detect conditions or events in, on or near an associated elevator car. A monitoring device monitors a status of the associated elevator car. The monitoring device communicates with the detector for receiving data indicative of any event or condition detected by the detector. The monitoring device provides an output that associates the status of the elevator car at a time of any detected event or condition with an indication of the detected event or condition including a reproduction of the detected event or condition.

An exemplary method of monitoring an elevator arrangement includes detecting an event or condition in, on or near an elevator car. A status of the elevator is determined including any movement or position of the elevator car. An output is generated that associates an indication of the detected event or condition including a reproduction of the detected event or condition with the status of the elevator arrangement at the time of the detected event or condition.

The various features and advantages of the disclosed example will become apparent to those skilled in the art from the following detailed description. The drawings that accompany the detailed description can be briefly described as follows.

DETAILED DESCRIPTION

Figure 1:
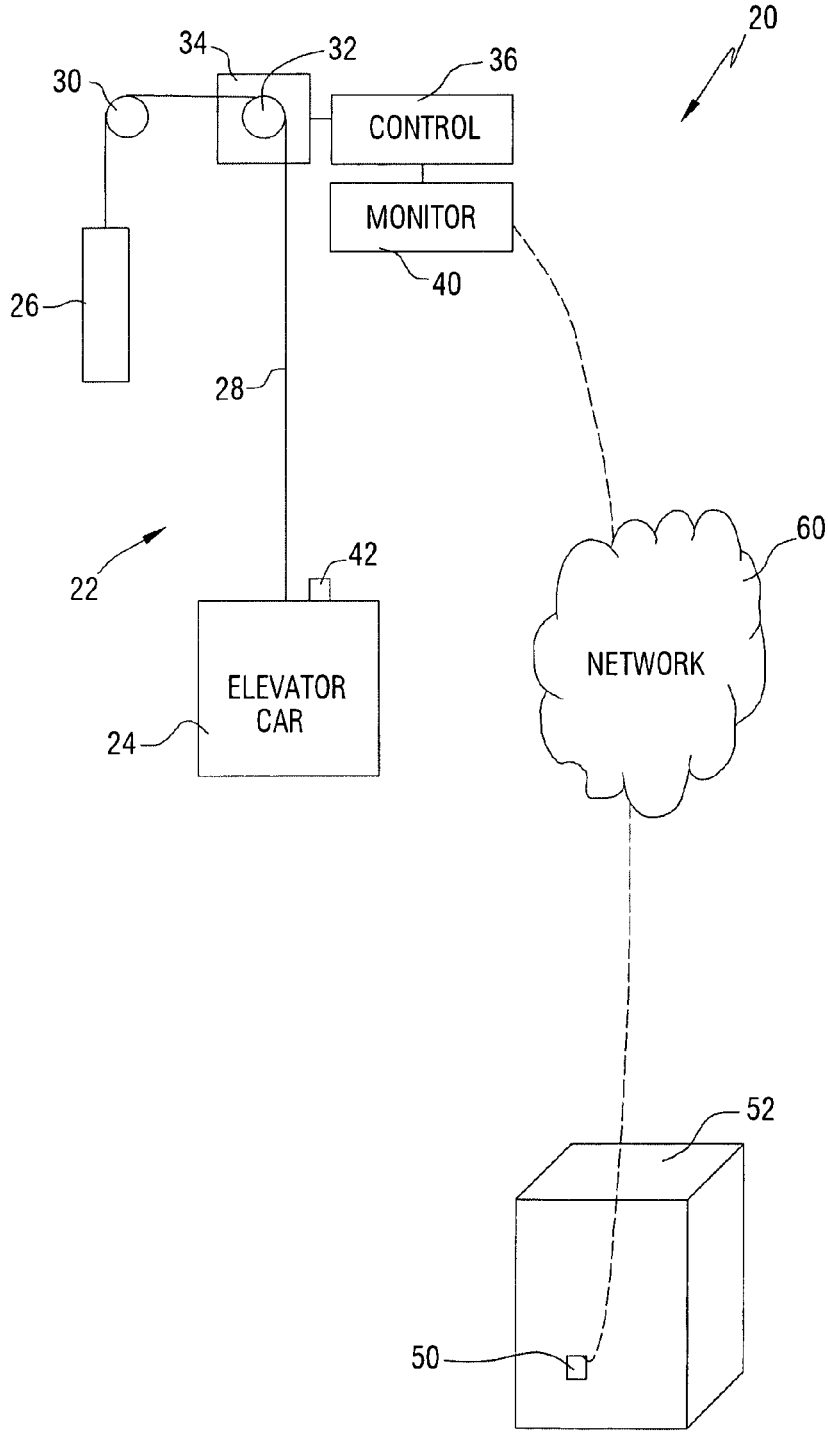
FIG. 1 schematically illustrates selected portions of an elevator arrangement and a system for monitoring the elevator arrangement.

FIG. 1 schematically illustrates a system 20 for monitoring an elevator arrangement 22. This example includes an elevator car 24 associated with a counterweight 26. A roping arrangement 28 supports the weight of the elevator car 24 and the counterweight 26. The roping arrangement 28 moves along sheaves 30 and 32 responsive to operation of a machine 34 to cause desired movement of the elevator car 24 in a known manner. An elevator controller 36 controls operation of the machine 34 to move the elevator car 24 as desired and to maintain it in selected positions as needed.

A monitoring device 40 monitors the status of the elevator arrangement 22 including any movement and position of the elevator car 24. In this example, the monitoring device 40 is schematically illustrated separate from the elevator controller 36. In some examples, the monitoring device 40 is part of the elevator controller 36 such as dedicated hardware, software, firmware or a combination of these within the elevator controller 36. In the illustrated example, the monitoring device 40 communicates with the elevator controller 36 to receive information regarding the movement or position of the elevator car 24. The monitoring device 40 in this example is capable of continuous, ongoing monitoring of all movement and position of the elevator car 24. The example monitoring device also uses or gathers information regarding various components of the elevator arrangement such as car doors, brakes, safety devices, guides and sheaves. Such information may be part of the determined status.

A detector 42 is situated relative to the elevator car 24 for detecting an event or condition in, on or near the elevator car 24. The detector 42 may, for example, detect component movement, vibrations, noises associated with movement of the elevator car 24 within a hoistway, operation of the machine 34, movement of doors on the elevator car 24, operation of a brake associated with the machine 34 or any other event or condition that may be detectable in the vicinity of the elevator car 24. Examples of detectors 42 include microphones, vibration transducers, cameras (video or still) or pressure transducers. While the detector 42 may take a variety of forms in some examples, a sound detector such as a microphone is used below as an example for discussion purposes. The monitoring device 40 will be described below as being used for monitoring and reporting detected sounds but is not necessarily limited to that particular use. Some example monitoring devices 40 used in example embodiments of this invention are capable of monitoring other events or conditions that are detectable in, on or near an elevator car by other example detectors of various forms.

The monitoring device 40 communicates with the example detector 42 so that the monitoring device 40 receives data indicative of any sound detected by the sound detector 42. The monitoring device 40 associates detected sounds and elevator status information at corresponding times. The monitoring device 40 provides an output that associates the status (e.g., the movement or position of the elevator car 24 or a particular component associated with the elevator car 24 such as a door or a door mover) at a time of any detected sound with an indication of the detected sound that includes a reproduction of that which was detected by the detector 42. In one example, the output comprises an audible reproduction of the sound that occurred in, on or near the elevator car as detected by the detector 42.

In the illustrated example, the output from the monitoring device 40 is communicated to a processor 50 that is located remotely from the site of the elevator arrangement 22. As schematically shown in FIG. 1, the example processor 50 is situated within a building 52 that is located remotely from the building or structure within which the elevator arrangement 22 is situated. Communication between the monitoring device 40 and the processor 50 occurs over a communication network 60. In one example, the communication network 60 includes line-based telecommunication devices. In another example, the network 60 includes equipment that facilitates wireless communications between the monitoring device 40 and the processor 50. Another example includes some wireless and some line-based communications.

The processor 50 allows an individual at the remote location (i.e., the building 52) to remotely monitor sounds within the elevator arrangement 22. In one example, the processor 50 provides an audible output that allows an individual at the remote location to listen to noise or sounds that occurred in or near the elevator car 24. In one example, the monitoring device 40 digitizes the sound recorded by the sound detector 42 and transmits a data file of the digitized sound to the processor 50. The example digitized sound is a reproduction of the actual sound detected by the detector 42. The processor 50 generates a sound file such as a .WAV format file that can be played back by an individual at the remote location to listen to the sound that occurred in the elevator arrangement 22.

The output from the monitoring device 40 also provides information regarding a status of the elevator arrangement 22 at the time of the detected sound. Example status information includes whether the elevator car 24 is moving or remains at a particular position when the sound is occurring. The information regarding the elevator arrangement status also includes information such as whether doors on the elevator car are moving, opened or closed. In one example, any information available from the controller 36 is tracked by the monitoring device 40 and provided in the output to convey information regarding the status of a variety of components within the elevator arrangement 22 at a time of a detected sound. Having the status information available with an audible playback of a detected sound allows an individual at a remote location to diagnose the condition of the elevator arrangement 22 associated with a detected sound.

Having remote monitoring capabilities such as those provided by the illustrated example facilitates more economically servicing elevator systems. For example, it is possible for an experienced individual to remotely monitor various elevator arrangements and to provide an appropriate instruction to have a technician sent to a particular site when detected elevator arrangement conditions warrant service, for example. Additionally, the individual at the remote location can troubleshoot and diagnose the situation to recommend a potential maintenance or repair procedure before a technician arrives at the scene. This presents cost and time savings as a technician does not need to arrive at the scene, then diagnose the situation and then decide how to address it. By enabling an individual to predetermine the likely situation and a probable cause of it, the illustrated example facilitates more quickly remedying or servicing an elevator arrangement in need of attention.

One aspect of the example monitoring device 40 is that it allows the remote individual to specify particular elevator functions such as moving the elevator car 24, controlling door functions and the speed at which the elevator car or components are moved. The example monitoring device responsively directs control of the elevator to achieve the specified elevator function received from the remotely located individual. Given this description, those skilled in the art will realize what range of possible remotely instigated or remotely controlled functions or operations will be useful for monitoring or diagnosing a particular elevator installation.

Another feature associated with the monitoring capabilities of the illustrated example is that the monitoring device 40 can provide the output indicating the condition of the elevator arrangement 22 on an ongoing, continuous basis if needed. The information from the monitoring device 40 is available to a remotely located individual even while the elevator car 24 is in service and available for carrying passengers during normal operation. This avoids the necessity of taking an elevator car out of service during a troubleshooting, maintenance operation, for example. Accordingly, the illustrated example enhances the efficiency and availability of an elevator arrangement by reducing the amount of time that an elevator car would have to be taken out of service to address any potential problems associated with detected noises.

Another feature of this example is that remote monitoring of a newly installed elevator is possible. This allows for recognizing potentially incorrectly installed components or potentially defective components before the elevator is placed into service.

Another feature of this example is an ability to establish a baseline sound profile for a newly installed elevator. Such a baseline profile can be used for later comparisons to determine routine scheduled maintenance dates, for example, based on actual data regarding a particular installation. This allows for customizing service schedules that can vary among different installations.

In one example, the monitoring device 40, the processor 50 or both is configured to recognize an expected or acceptable sound level associated with various conditions of the elevator arrangement 22. Whenever a sound is detected that deviates from the expected sound or range of expected sounds in a sufficient amount, an alert or alarm indication is provided by the processor 50, the monitoring device 40 or both. In other words, the illustrated example has the capability to perform real-time processing of audio information and can generate alerts or alarms that are used to inform appropriate personnel regarding the situation. The appropriate response can then be determined to meet the needs of a particular situation. Such an arrangement allows for automating a process of diagnosing potential current or future problems for an elevator arrangement without requiring manual intervention until a situation arises that is likely to require attention by service personnel.

In one example, the monitoring device continuously provides an output to the processor 50. In another example, the monitoring device 40 only provides an output to the processor 50 responsive to a determination by the monitoring device 40 that a detected sound is outside of an expected or acceptable range. Such an example limits the amount of communication required between the monitoring device 40 and the processor 50, which may prove useful where communication resources need to be conserved. In another example, the processor 50 is programmed to periodically instruct the monitoring device 40 to send output information on a predetermined or as-needed basis.

Figure 2:
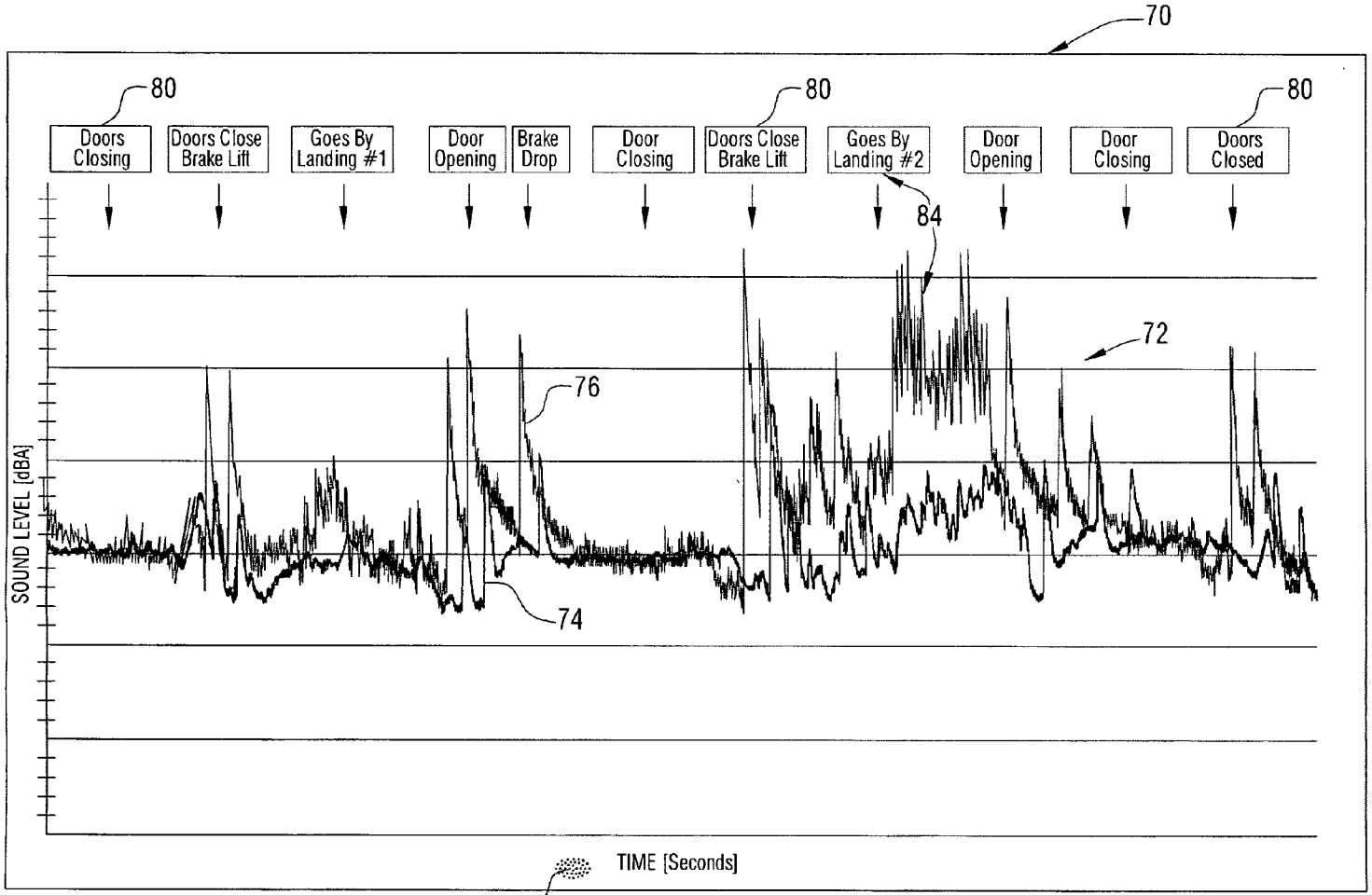
FIG. 2 schematically illustrates an example output on a user interface.

FIG. 2 schematically illustrates a user interface 70 that can be used with the processor 50 at a remote location such as the building 52 in the example of FIG. 1. In this example, the user interface 70 provides a visible output 72 regarding detected sounds and associated elevator status information. In this example, a plot 74 of sound pressure levels detected by the sound detector 42 shows a baseline or acceptable performance level of the elevator arrangement 22. The information providing the plot 74 is stored, for example, in memory associated with the processor 50 so that the processor 50 can make a comparison between the baseline or acceptable noise levels indicated by the plot 74 and actual sound levels associated with operation of the elevator arrangement.

In FIG. 2, a second plot 76 represents sound pressure levels detected by the sound detector 42 during a particular time of elevator system operation. As can be appreciated from FIG. 2, at several instances, the sound level shown by the plot 76 exceeds that of the plot 74. In one example, the processor 50 is configured to make determinations regarding such differences in sound level. In this example, an individual can see the differences in sound to evaluate or diagnose the condition of the elevator system.

As shown at 80, indications of the status of the elevator system are provided along with the visible indications of the detected sound levels. This allows an individual to troubleshoot or diagnose potential problem situations and to identify the elevator system component or function that is the likely cause of the undesirably high noise or sound level. In the example of FIG. 2, the increased noise as the elevator car passes the landing 2, which is indicated at 84, is considered an undesirably high amount of noise and an appropriate service technician is dispatched to address the situation.

The example of FIG. 2 includes a sound generator 86 such as a speaker that allows an individual to listen to an audible indication of the actual detected sound. This provides further enhanced abilities to remotely analyze and diagnose a situation at a particular elevator assembly.

Figure 3:
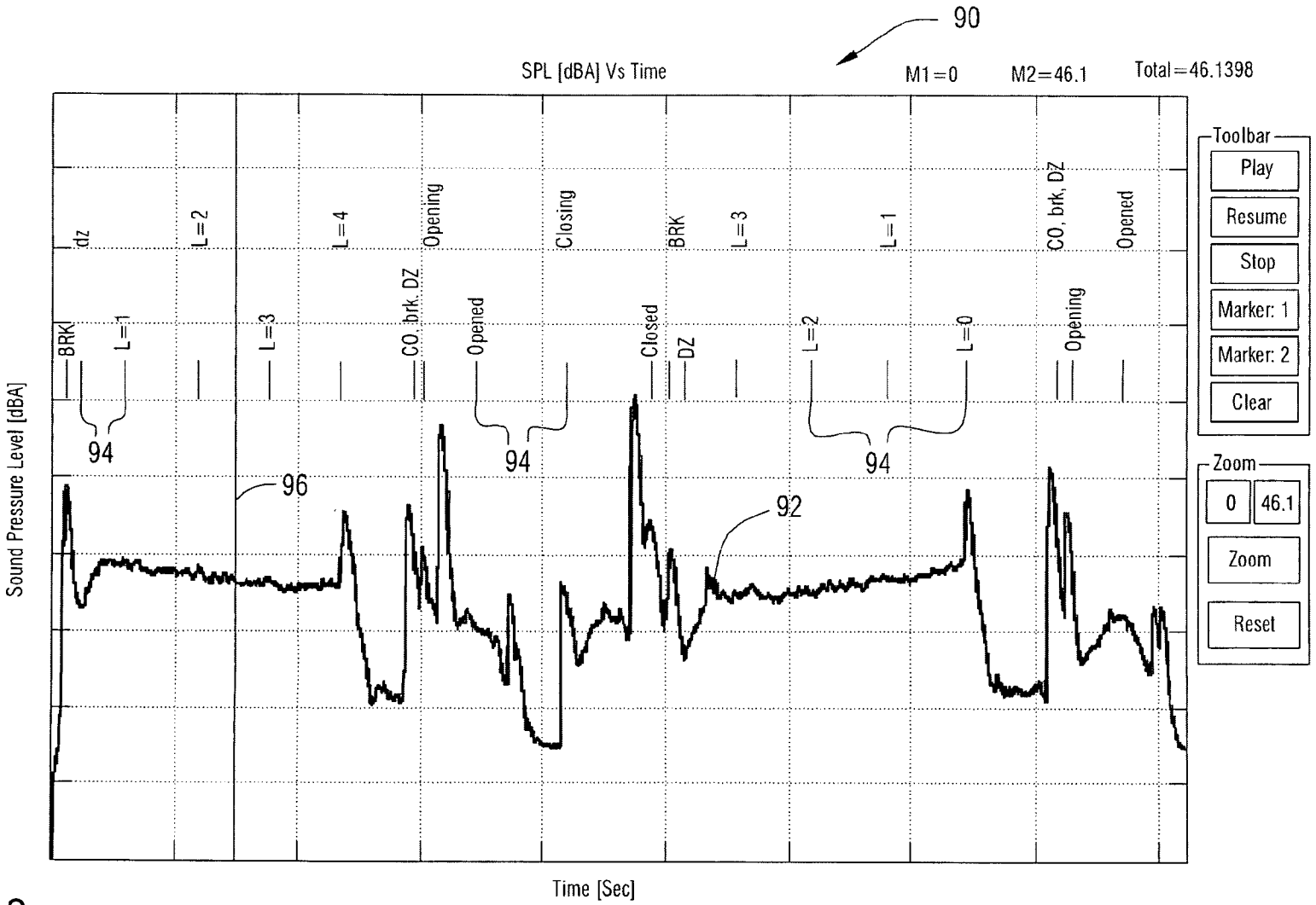
FIG. 3 schematically illustrates another example output.

FIG. 3 shows another example user interface 90 that is useful for remotely observing an elevator system event or condition. This example also allows an individual to remotely analyze sounds detected in, on or near an elevator car. A plot 92 shows detected sound levels over time. Indicators of elevator system status are provided at 94 for associating the status information with the coincident detected sound. Another feature of this example, is that a visual indicator 96 provides a visual indication of the portion (e.g., the location along the sound plot 92) to which an individual is listening at a given moment in time. The example indicator 96 allows an individual to assess the detected sound in relation to the system status indicators 94 and the audible sound available from the output provided by the monitoring device 40.

One such example allows for placing markings in a visual representation or into a sound file that allow an individual to return to specific points of interest in the output for later analysis or comparison to other sound files or outputs gathered at other or obtained from monitoring other elevator systems.

In one example, multiple output files or selected portions of output files such as the sound file portion of an output from the monitoring device 40 are maintained to allow analysis of changes over time or other ongoing comparisons.

Having the ability to remotely determine the likely cause of such noise based upon the combined information from the detected sound and the associated elevator status information gives a service technician in the field an ability to more quickly address the situation at the elevator site. This type of diagnosis from a remote location can occur while the elevator car is still in service.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A system for monitoring an elevator arrangement, comprising:

a detector arranged at least partially in a hoistway to detect an event or a condition in, on or near an associated elevator car; and a monitoring device at the hoistway site that is configured to monitor a status of the elevator arrangement, communicate with the detector for receiving data indicative of any event or condition detected by the detector, and provide an output that associates the monitored status of the elevator arrangement at a time of any detected event or condition with an indication of the detected event or condition including a reproduction of the detected event or condition that can be communicated to a location remote from the hoistway site of the monitoring device, the reproduction including a visual output indicative of a sound associated with the detected event and a corresponding audible output of the same sound.

2. The system of claim 1, wherein the monitoring device is configured to communicate the output to another device remotely located from a site of the monitoring device.

3. The system of claim 2, wherein the monitoring device determines a baseline reference of at least one acceptable event or condition;

determines whether any detected event or condition has an expected relationship with a corresponding acceptable event or condition; and provides the output to the other device responsive to the detected event or condition not having the expected relationship with the corresponding acceptable event or condition.

4. The system of claim 1, comprising a processor located remotely from the site of the monitoring device, the processor receiving the output from the monitoring device and generating a corresponding output that provides the reproduction of the detected event or condition.

5. The system of claim 4, wherein the processor generates an audible output representing a detected sound and a visible output representing the detected sound in association with the status of the elevator arrangement at the time of the detected sound.

6. The system of claim 5, wherein one of the monitoring device or the processor digitizes the indication of the detected sound such that the corresponding sound file is digitized.

7. The system of claim 6, comprising a storage that maintains a plurality of digitized sound files and wherein the processor is configured to provide an indication of a comparison of at least one feature of selected ones of the sound files with corresponding elevator status information.

8. The system of claim 6, comprising a user interface that provides an audible output corresponding to the sound file that can be heard by a user remote from the site of the monitoring device.

9. The system of claim 5, wherein the monitoring device performs on-going, real-time monitoring; and one of the monitoring device or the processor determines whether any detected sound has an expected relationship with a corresponding acceptable sound and provides an output indicating an event corresponding to the detected sound not having the expected relationship with the corresponding acceptable sound.

10. The system of claim 1, wherein the monitoring device provides the output on an ongoing basis while the corresponding elevator car is in service for carrying passengers.

11. The system of claim 1, wherein the detector comprises a sound detector and the reproduction of the output allows an individual remote from the monitoring device to audibly hear a sound detected by the sound detector.

12. The system of claim 1, wherein the monitoring device allows another remotely located device or individual to specify particular elevator functions and the monitoring device responsively directs control of the elevator to perform the specified function.

13. The system of claim 1, wherein the monitoring device output allows for simultaneously, manually observing an audible indication of a sound detected by the detector, a visible indication of the detected sound and an indication of the associated monitored status of the elevator arrangement.

14. A method of monitoring an elevator arrangement, comprising the steps of:

detecting an event or condition in, on or near an elevator car;

determining a status of the elevator arrangement at the site of the elevator car; and generating an output from the site of the elevator car, the output associating an indication of the detected event or condition with the status of the elevator arrangement at the time of the detected event or condition including a reproduction of the detected event or condition that can be communicated to a location remote from the hoistway site of the monitoring device, the reproduction including a visual output indicative of a sound associated with the detected event and a corresponding audible output of the same sound.

15. The method of claim 14, comprising communicating the output to another device remotely located from the site of the elevator car.

16. The method of claim 15, comprising determining a baseline reference of an acceptable event or condition;

determining whether any detected event or condition has an expected relationship with a corresponding acceptable event or condition; and providing the output to the other device responsive to the detected event or condition not having the expected relationship with the corresponding acceptable event or condition.

17. The method of claim 14, comprising generating a corresponding output file that comprises the reproduction of the detected event or condition at a location remote from the elevator arrangement.

18. The method of claim 14, comprising generating an audible output reproducing a detected sound;

generating a visible output representing the detected sound; and providing an indication of an associated status of the elevator arrangement at the time of the detected sound.

19. The method of claim 18, comprising simultaneously performing the generating and providing steps.

20. The method of claim 18, comprising digitizing the indication of the detected sound such that a sound file of the output is digitized.

21. The method of claim 20, comprising maintaining a plurality of digitized sound files; and selectively providing an indication of a comparison of at least one feature of selected ones of the sound files with corresponding elevator status information.

22. The method of claim 14, comprising providing the output corresponding to any detected event or condition such that the reproduction of the detected event or condition can be observed by a user at a location remote from the elevator car.

23. The method of claim 14, comprising providing the output on an ongoing basis while the corresponding elevator car is in service for carrying passengers.

* * * * *